US012031389B1

(12) United States Patent
Cuddapah et al.

(10) Patent No.: US 12,031,389 B1
(45) Date of Patent: Jul. 9, 2024

(54) STICK SLIP TOOL

(71) Applicant: Downhole Well Solutions, LLC, Spring, TX (US)

(72) Inventors: Avinash Hariprasad Cuddapah, Pearland, TX (US); Michael Dan Billings, Willis, TX (US)

(73) Assignee: Downhole Well Solutions, LLC, Spring, TX (US)

( * ) Notice: Subject to any disclaimer, the term of this patent is extended or adjusted under 35 U.S.C. 154(b) by 71 days.

(21) Appl. No.: 17/974,732

(22) Filed: Oct. 27, 2022

Related U.S. Application Data

(60) Provisional application No. 63/272,366, filed on Oct. 27, 2021.

(51) Int. Cl.
*E21B 17/07* (2006.01)
*E21B 17/22* (2006.01)

(52) U.S. Cl.
CPC ..... *E21B 17/073* (2013.01); *E21B 17/22* (2013.01)

(58) Field of Classification Search
CPC ..... E21B 17/22; E21B 17/073
See application file for complete search history.

(56) References Cited

U.S. PATENT DOCUMENTS 4,199,999 A * 4/1980 Metz ..... F16H 25/2233 74/424.9
5,267,741 A * 12/1993 Leitner ..... B23B 31/1238 279/140
10,851,589 B2 * 12/2020 von Gynz-Rekowski ..... E21B 4/003
2004/0129457 A1 * 7/2004 McNeilly ..... E21B 4/02 175/323
2005/0092527 A1 * 5/2005 Le ..... E21B 17/1007 175/325.6
2005/0181329 A1 * 8/2005 Maitre ..... A61B 17/162 433/129
2007/0000695 A1 * 1/2007 Laflin ..... E21B 17/073 175/57
2009/0218143 A1 * 9/2009 Sanfelice ..... E21B 7/18 175/77
2012/0325561 A1 * 12/2012 Leblanc ..... F16C 19/10 384/590
2015/0023137 A1 * 1/2015 Benson ..... E21B 4/10 367/82
2017/0081927 A1 * 3/2017 Leiper ..... E21B 17/05

* cited by examiner

*Primary Examiner* — Shane Bomar
(74) *Attorney, Agent, or Firm* — Winstead PC

(57) ABSTRACT

A rotary glide system for a downhole tool includes a shaft having a plurality of helical grooves formed into an outer surface of the shaft, and a ball bearing sleeve configured to fit around the shaft. The ball bearing sleeve includes a plurality of helical grooves formed into an inner surface of the sleeve, a first slot that extends from a first end of the ball bearing sleeve and intersects a helical groove of the plurality of helical grooves, and a first ball stop comprising a first tab that extends into the first slot of the ball bearing sleeve.

16 Claims, 9 Drawing Sheets

STICK SLIP TOOL

CROSS-REFERENCE TO RELATED APPLICATIONS

This patent application claims priority to, and incorporates by reference the entire disclosure of, U.S. Provisional Patent Application No. 63/272,366, filed on Oct. 27, 2021.

TECHNICAL FIELD

The present disclosure relates generally to downhole tools and more particularly, but not by way of limitation, to a device for relieving excess torque in a drill string.

BACKGROUND

This section provides background information to facilitate a better understanding of the various aspects of the disclosure. It should be understood that the statements in this section of this document are to be read in this light, and not as admissions of prior art.

When drilling through various geological formations, for example for the production of hydrocarbons, a drill string may experience a variation in torque loads. The variation in torque loads can cause oscillations in the drill string that damage the drill string and its components. The variation in torque loads can be attributable to torsional stick slip. Torsional stick slip occurs when the rotational speed of the bottom hole assembly varies from a steady speed. The variation in speed is caused by, for example, the drill bit encountering different resistances. As the speed of the drill bit varies, the torsional load upon the drill string changes, which can damage the drill string and/or cause failures.

SUMMARY

This summary is provided to introduce a selection of concepts that are further described below in the Detailed Description. This summary is not intended to identify key or essential features of the claimed subject matter, nor is it to be used as an aid in limiting the scope of the claimed subject matter.

A rotary glide system for a downhole tool includes a shaft having a plurality of helical grooves formed into an outer surface of the shaft, and a ball bearing sleeve configured to fit around the shaft. The ball bearing sleeve includes a plurality of helical grooves formed into an inner surface of the sleeve, a first slot that extends from a first end of the ball bearing sleeve and intersects a helical groove of the plurality of helical grooves, and a first ball stop comprising a first tab that extends into the first slot of the ball bearing sleeve.

A stick slip tool includes a rotary glide system. The rotary glide system includes a shaft comprising a plurality of helical grooves formed into an outer surface of the shaft and a ball bearing sleeve configured to fit around the shaft. The ball bearing sleeve includes a plurality of helical grooves formed into an inner surface of the sleeve, a first slot that extends from a first end of the ball bearing sleeve and intersects a helical groove of the plurality of helical grooves, and a first ball stop comprising a first tab that extends into the first slot of the ball bearing sleeve. The stick slip tool further includes a spring mandrel coupled at a first end to the shaft and a spring stack situated around the spring mandrel. The spring stack resists axial motion of the spring mandrel.

BRIEF DESCRIPTION OF THE DRAWINGS

A more complete understanding of the subject matter of the present disclosure may be obtained by reference to the following Detailed Description when taken in conjunction with the accompanying Drawings wherein.

WRITTEN DESCRIPTION

It is to be understood that the following disclosure provides many different embodiments, or examples, for implementing different features of various embodiments. Specific examples of components and arrangements are described below to simplify the disclosure. These are, of course, merely examples and are not intended to be limiting. The section headings used herein are for organizational purposes and are not to be construed as limiting the subject matter described.

Figure 1:
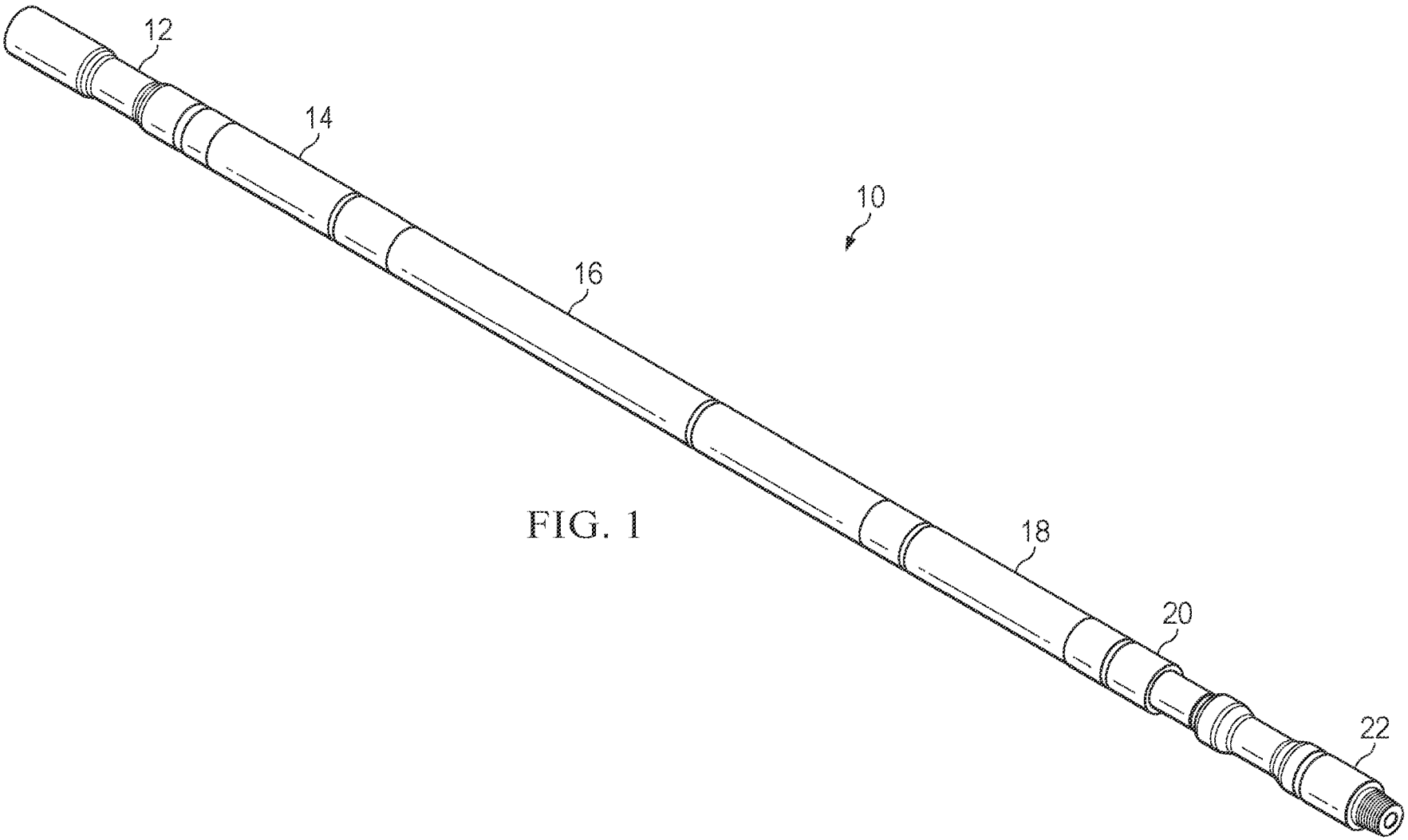
FIG. 1 is a perspective view of a stick slip tool according to aspects of the disclosure.
Figure 2:
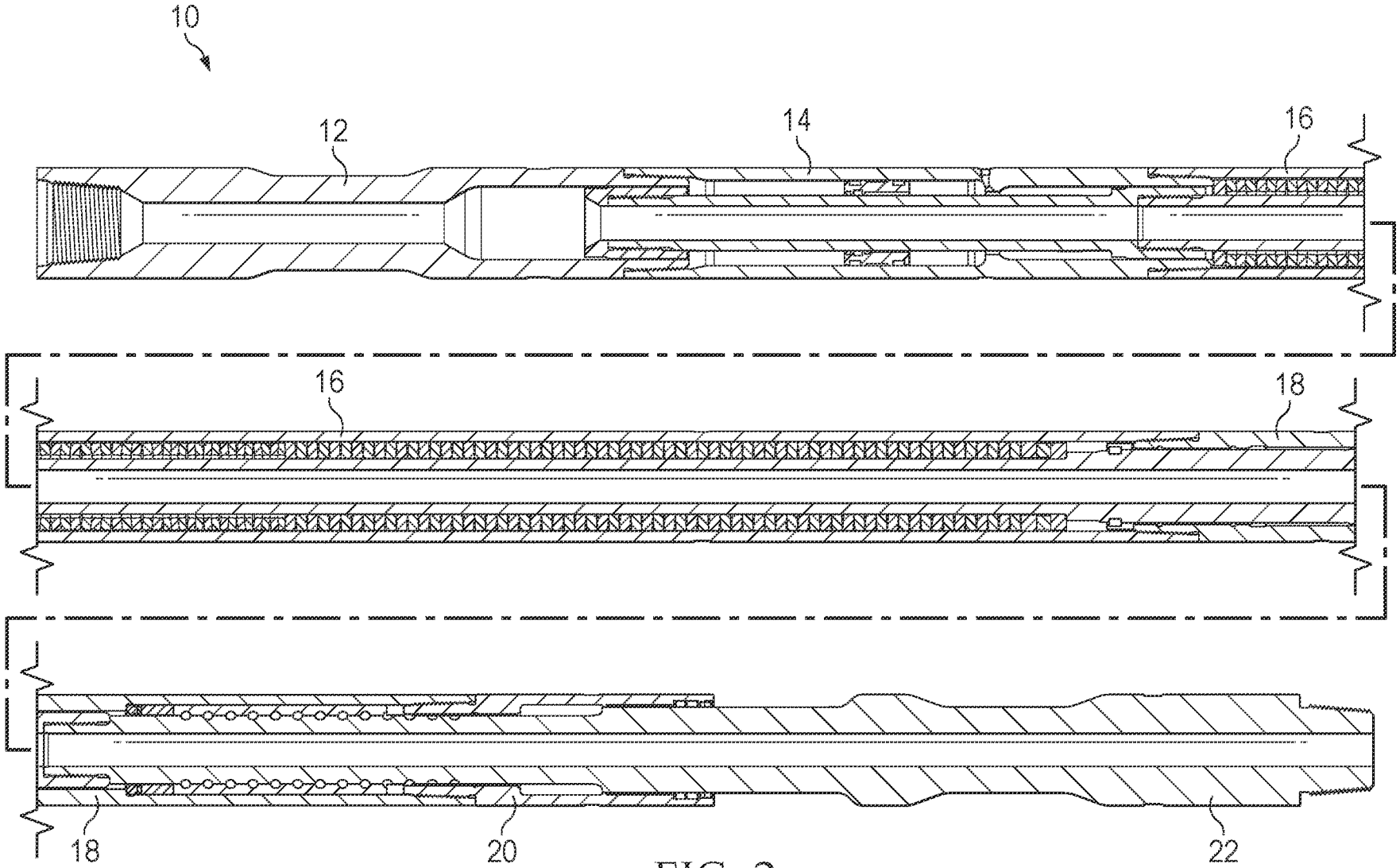
FIG. 2 is a sectioned side view of a stick slip tool according to aspects of the disclosure.

FIGS. 1 and 2 illustrate a stick slip tool 10 according to aspects of the disclosure. FIG. 1 is a perspective view of stick slip tool 10 and FIG. 2 is a sectioned side view of stick slip tool 10. Referring collectively to FIGS. 1 and 2, stick slip tool 10 includes a top sub 12, a piston housing 14, a spring barrel 16, a rotary glide seal housing 18, a lower seal housing 20, and a screw shaft 22. Stick slip tool 10 is for use in drilling operations and mitigates reactionary torques loads that can be encountered while drilling. Reactionary torque loads can be created, for example, when the drill bit gets hung up while drilling, when the resistance encountered by the drill bit suddenly increases, and the like. Sudden increases in resistance can result in torque loads that create oscillations in the drill string. In some instances, these oscillations can damage or break components of the drill string. Stick slip tool 10 prevents oscillations by reducing weight upon the drill bit. Weight upon the drill bit is reduced by dynamically and passively (i.e., occurs automatically in reaction to increased torque loads) shortening a length of the drill string.

Figure 3:
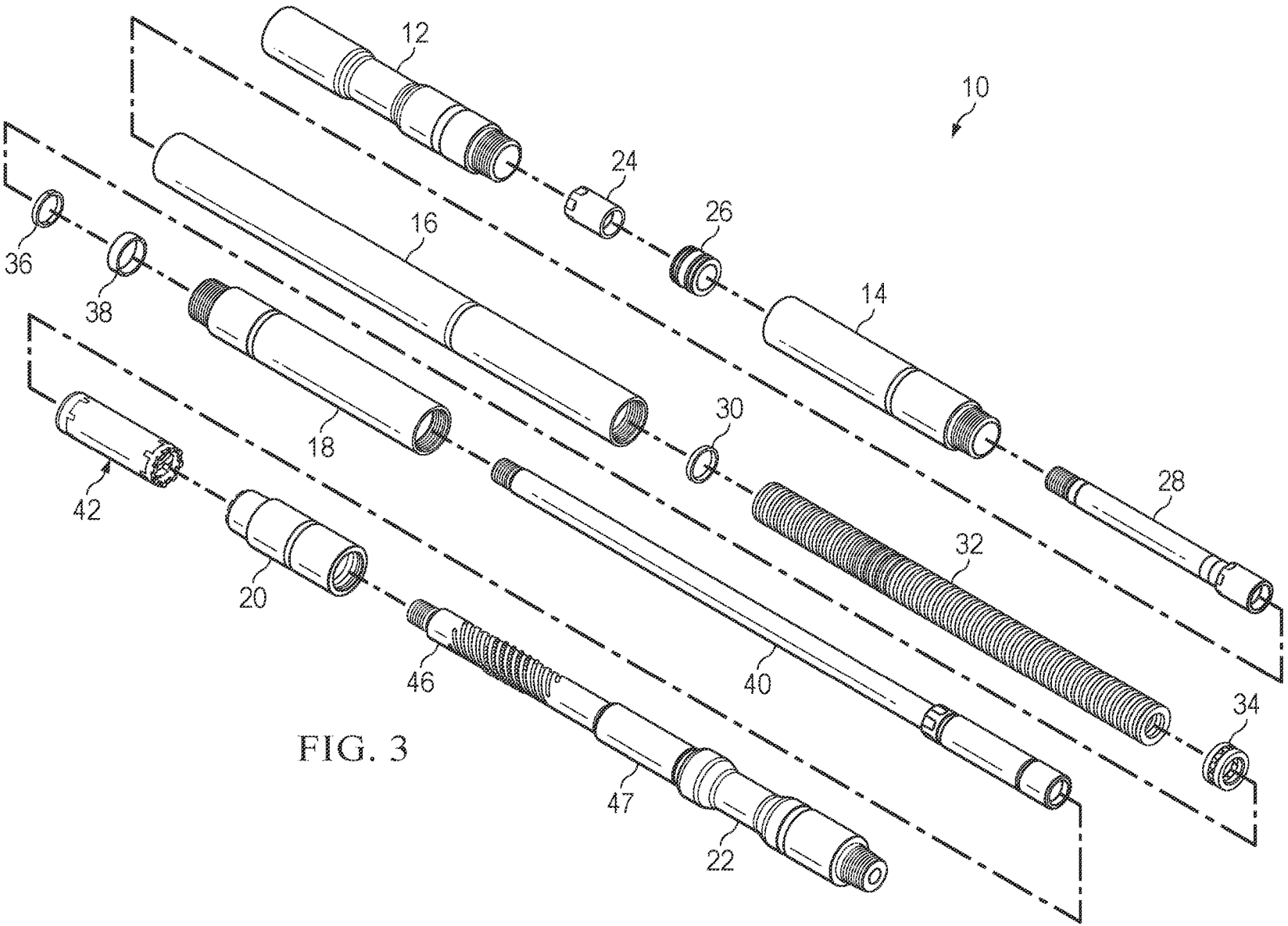
FIG. 3 is an exploded assembly of a stick slip tool according to aspects of the disclosure.
Figure 4:
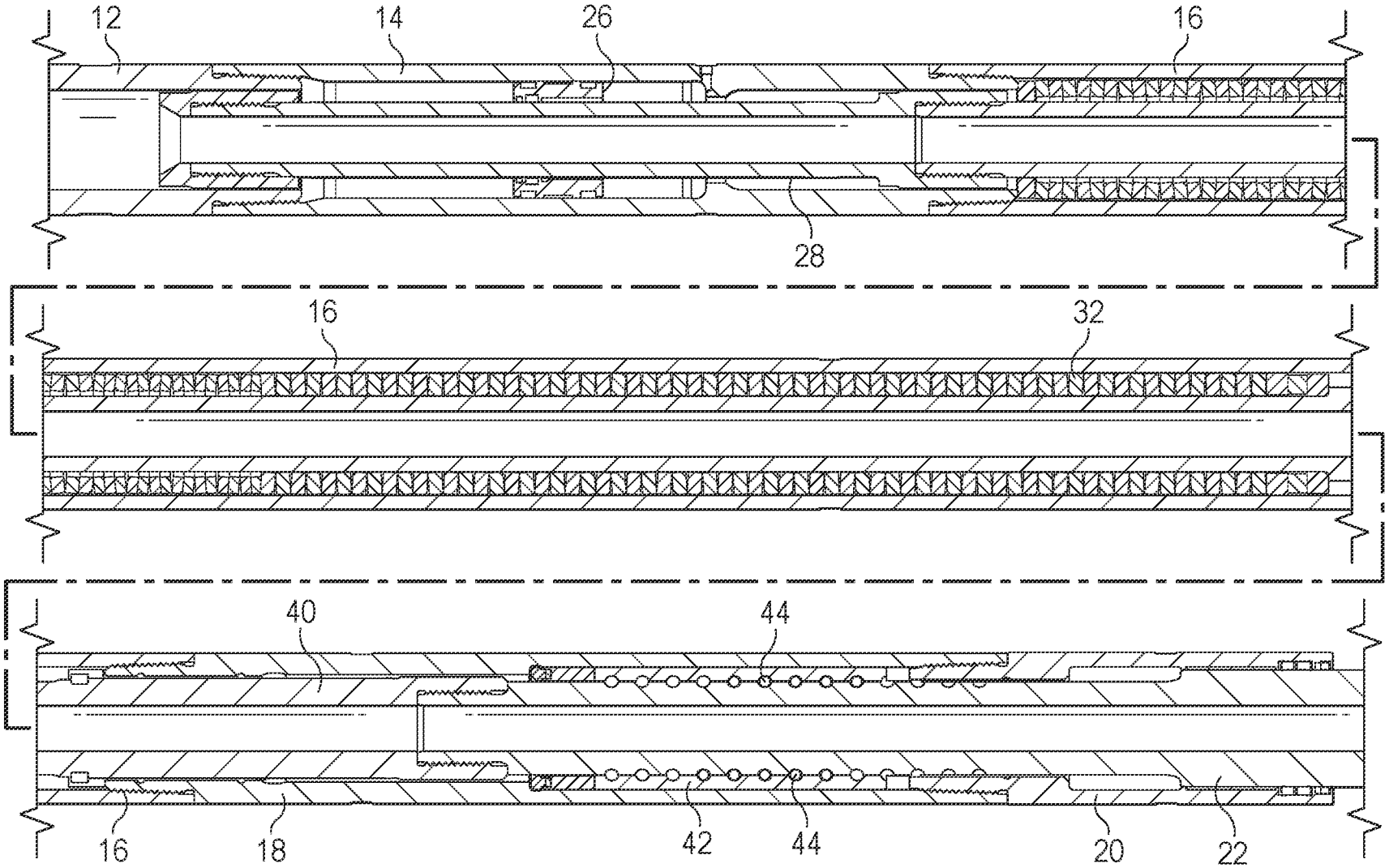
FIG. 4 is a close-up sectioned side view of a stick slip tool according to aspects of the disclosure.

FIG. 3 is an exploded assembly of stick slip tool 10 according to aspects of the disclosure. FIG. 4 is a close-up sectioned view of stick slip tool 10. Referring to FIGS. 3 and 4 collectively, top sub 12 is configured to couple stick slip tool 10 to a bottom end of a drill string (e.g., a threaded connection or the like). When connected to the bottom end of the drill string, stick slip tool 10 is positioned downhole relative to a motor of the drill string and uphole relative to a rotary steerable system of the drill string (e.g., see FIG. 5). A piston nut 24 and a floating piston 26 are positioned within piston housing 14. Piston nut 24 secures floating piston 26 to a wash pipe 28. Floating piston 26 is movably retained within piston housing 14 and separates mud/oil within stick slip tool 10 to regulate pressure. Wash pipe 28 extends into piston housing 14 and includes a first end that extends through floating piston 26. Piston housing 14 couples between top sub 12 and spring barrel 16. A spring stack 32 (e.g., a series of Bellville washers or the like) is housed within spring barrel 16. A first end of spring stack 32 bears against preload ring 30, and a second end of spring stack 32 bears against a thrust bearing stack 34, a split ring 36, and a stop ring 38. A spring mandrel 40 includes a first end that abuts screw shaft 22 and a second end that abuts a second end of wash pipe 28. A rotary glide system ("RGS") 42 is secured within rotary glide seal housing 18 such that it does not rotate relative thereto. RGS 42 includes a plurality of ball bearings 44 and will be discussed in more detail below. Screw shaft 22 includes a bearing section 46 and a sealing section 47. Bearing section 46 includes a plurality of helical groves to accommodate the plurality of ball bearings 44. Sealing section 47 includes a smooth surface that seals with an inner surface of lower seal housing 20.

Figure 5:
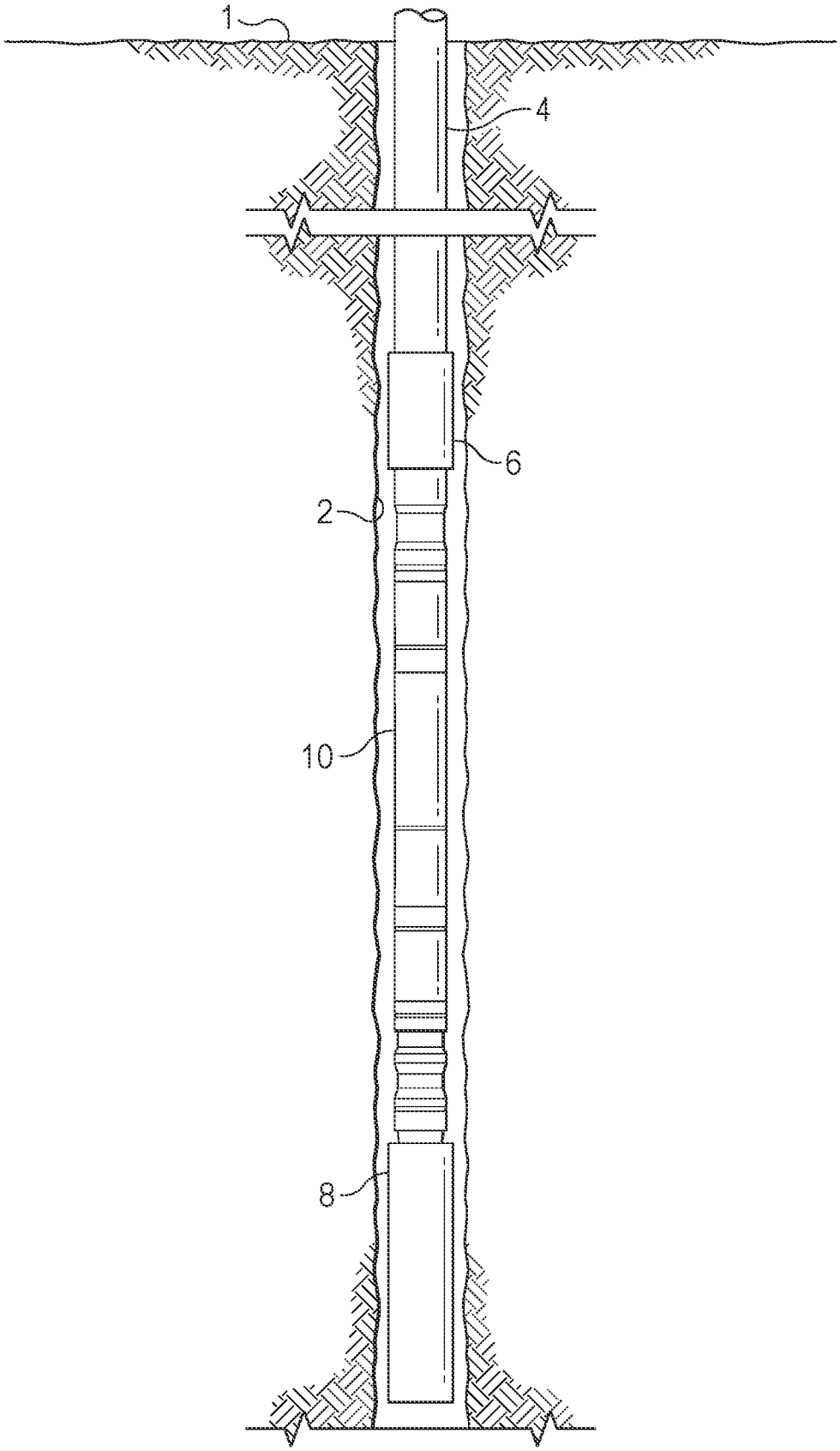
FIG. 5 is a schematic illustration of a stick slip tool positioned downhole according to aspects of the disclosure.

FIG. 5 is a schematic illustration of stick slip tool 10 positioned downhole according to aspects of the disclosure. FIG. 5 illustrates stick slip tool 10 disposed within a wellbore 2. A tubing string 4 extends from the surface 1, and is coupled to a motor 6 at a distal end. Stick slip tool 10 is coupled downhole from motor 6. In some aspects, other components may be inserted between motor 6 and stick slip tool 10. A rotary steerable system 8 is coupled downhole from stick slip tool 10. In some aspects, other components may be inserted between stick slip tool 10 and rotary steerable system 8.

Figure 6:
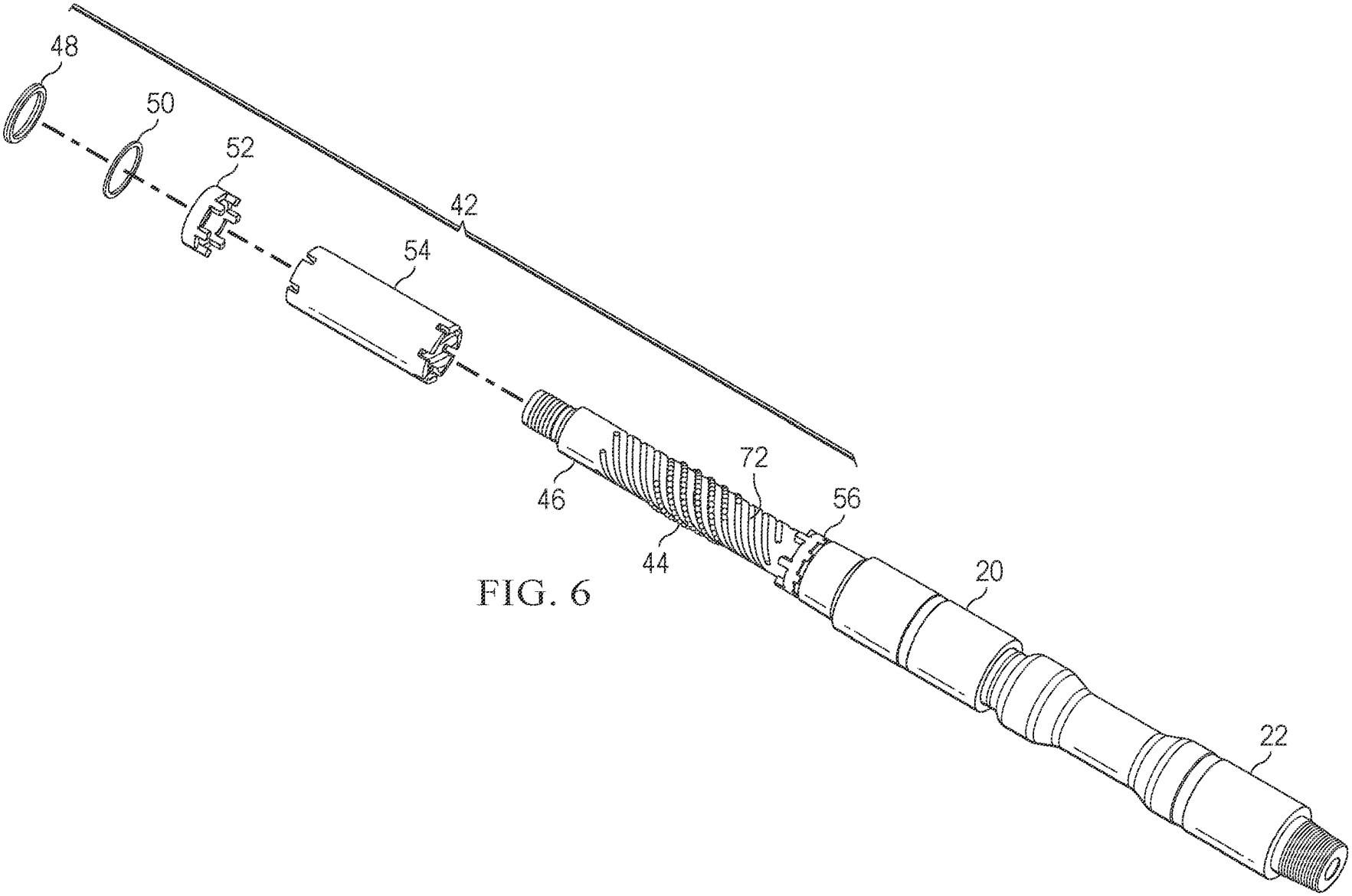
FIG. 6 is a partially exploded assembly of a stick slip tool according to aspects of the disclosure.
Figure 7:
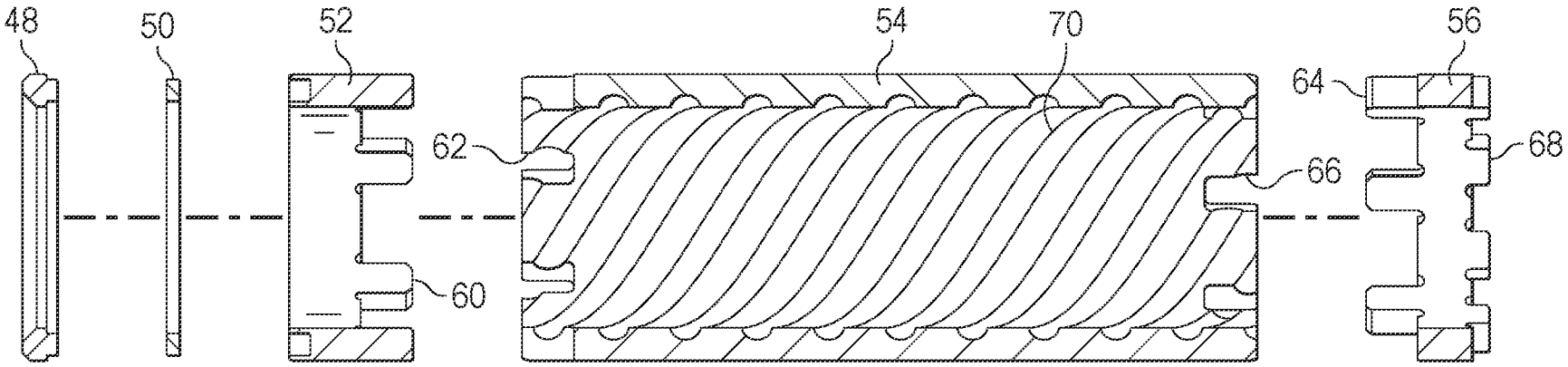
FIG. 7 is a sectioned exploded assembly of a rotary glide system according to aspects of the disclosure.

FIG. 6 is a partially exploded assembly of stick slip tool 10 according to aspects of the disclosure. In FIG. 6, rotary glide seal housing 18 has been removed to better show how RGS 42 is assembled onto screw shaft 22. FIG. 7 illustrates is s sectioned exploded assembly of RGS 42 according to aspects of the disclosure. Referring collectively to FIGS. 6 and 7, RGS 42 includes a crushwasher cap 48, a crushwasher 50, an upper ball stop 52, ball bearing sleeve 54, a plurality of ball bearings 44, and a lower ball stop 56. Crushwasher cap 48 and crushwasher 50 are sandwiched between upper ball stop 52 and rotary glide seal housing 18. Upper ball stop 52 includes tabs 60 that mate with corresponding slots 62 formed into a first end of ball bearing sleeve 54. A second end of ball bearing sleeve 54 similarly includes slots 66 that mate with tabs 64 of lower ball stop 56. Tabs 68 extend from lower ball stop 56 into lower seal housing 20 to prevent rotational slippage of RGS 42.

Ball bearing sleeve 54 includes a plurality of helical grooves 70 that align with a plurality of helical grooves 72 of screw shaft 22 (see FIG. 6) to accommodate the plurality of ball bearings 44. The plurality of ball bearings 44 permit smooth rotation between screw shaft 22 and RGS 42. Distal ends of tabs 60, 64 of ball stops 52, 56, respectively, extend into ends of the plurality of helical grooves 70, 72 to prevent the plurality of ball bearings 44 from exiting ball bearing sleeve 54.

Stick slip tool 10 dynamically controls a depth of cut of a drill bit in relation to the reactive torque via RGS 42. RGS 42 converts reactive torque into axial motion that bears against spring stack 32. The axial motion reduces engagement of the drill bit with the formation while dampening torque spikes to maintain an optimal weight and torque at the bit, allowing the bit to drill ahead instead of stall, which reduces damage to string components. When the torque spike is mitigated, spring stack 32, which was compressed by the axial motion, extends the tool back to its equilibrium operating point. A stiffness of spring stack 32 is configured for the expected drilling parameters (e.g., expected torsional loads).

Figure 8:
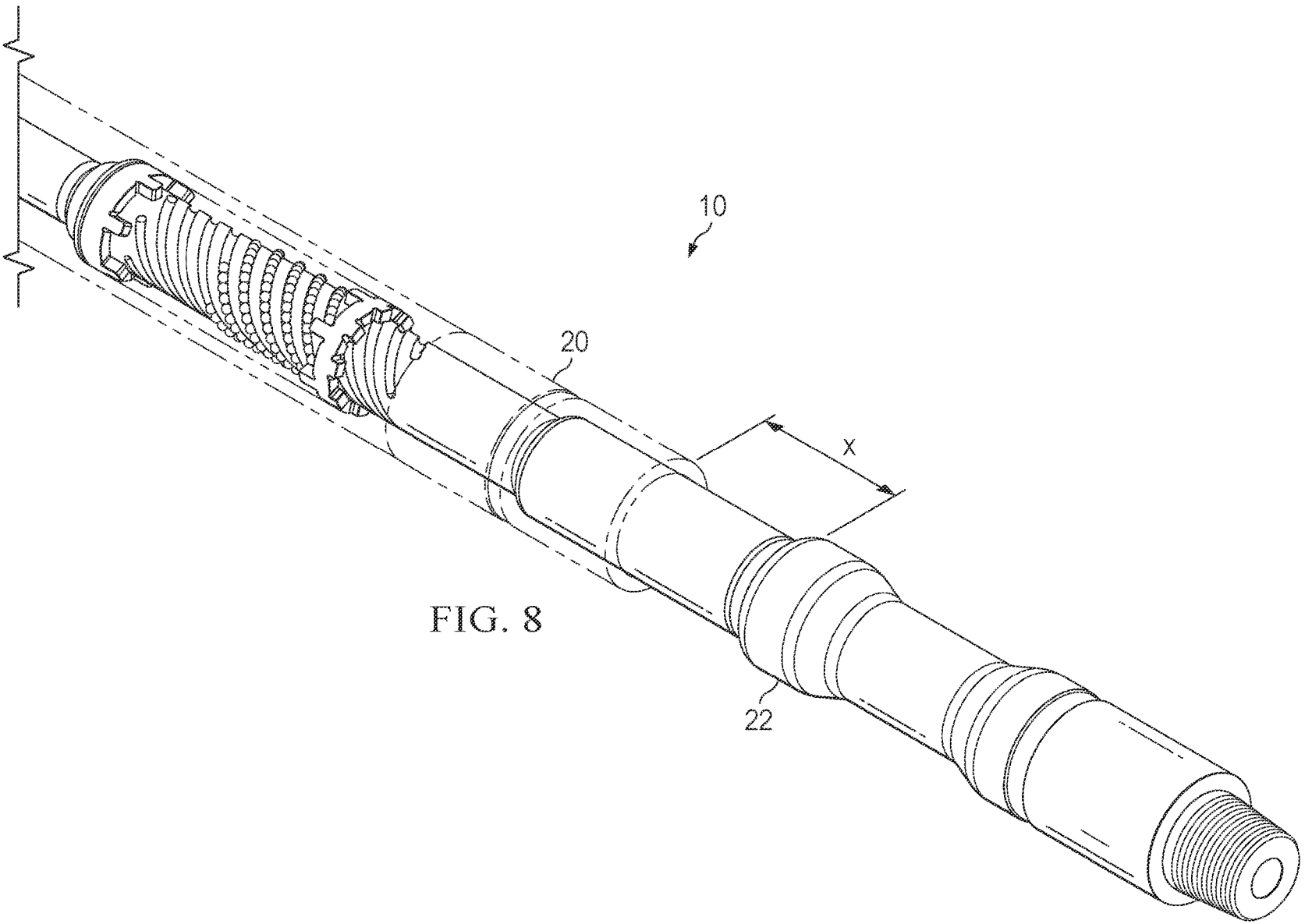
FIG. 8 is a partial perspective view of a rotary glide system in an elongated position according to aspects of the disclosure.
Figure 9:
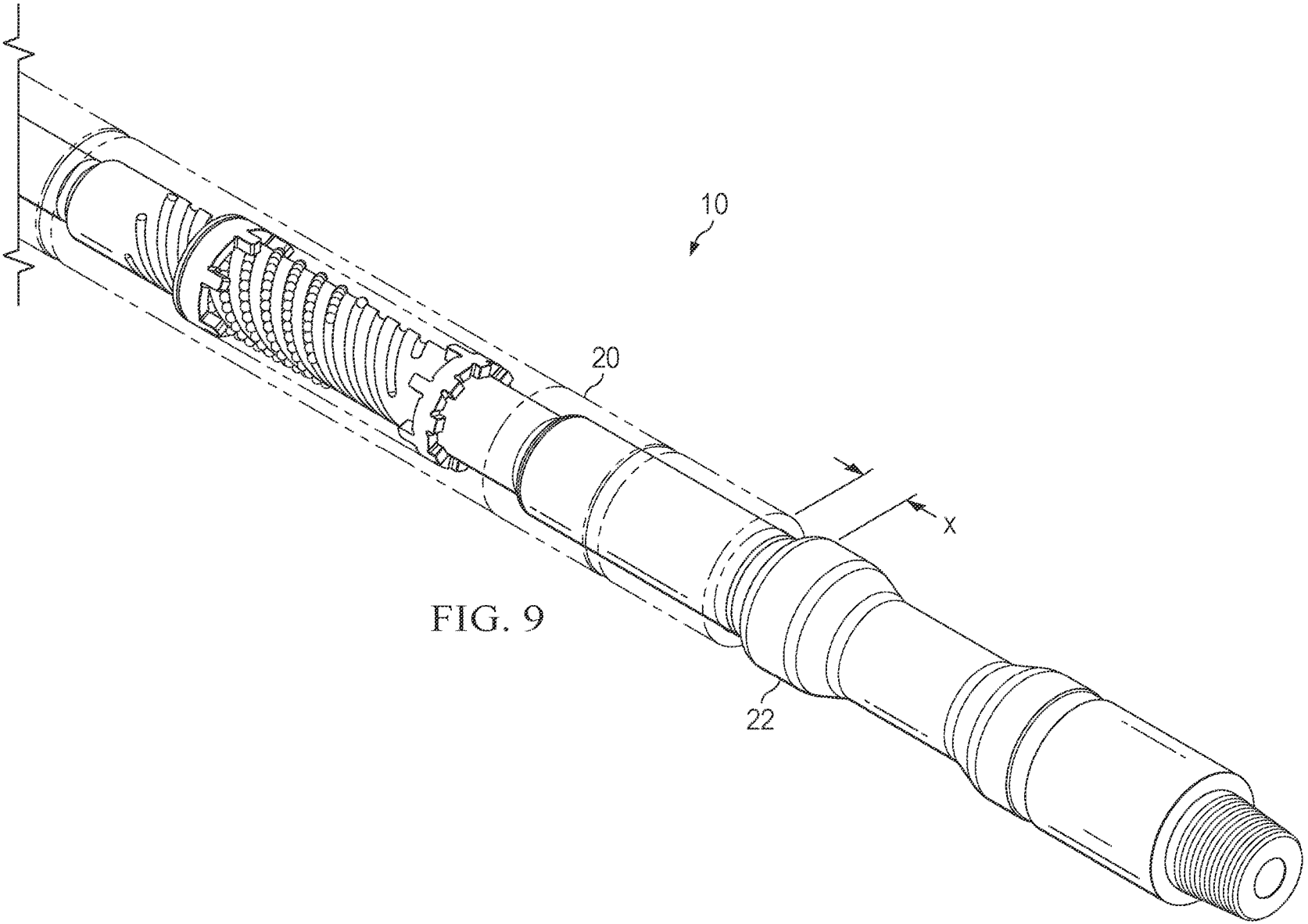
FIG. 9 is a partial perspective view of the rotary glide system of FIG. 8 in a compressed position according to aspects of the disclosure.

FIG. 8 illustrates stick slip tool 10 in an elongated configuration in the absence of sufficient reactionary torque to compress spring stack 32. In the elongated configuration, lower seal housing 20 and screw shaft 22 are spaced apart a distance X. FIG. 9 illustrates stick slip tool 10 in a compressed configuration resulting from the presence of sufficient reactionary torque to compress spring stack 32. In the compressed configuration, the distance X is reduced compared to FIG. 8 as screw shaft 22 has been rotated relative to RGA 42 (which is rotationally fixed relative to lower seal housing 20) as result of reactionary torque encountered while drilling. In FIGS. 8 and 9, ball bearing sleeve 54 has been hidden from view and lower seal housing 20 has been made transparent for the sake of clarity.

By way of example, during a drilling operation, the bottom hole assembly may encounter a denser formation. The change in density of the formation can result in an increase in reactionary torque that acts upon the drill string. If the reactionary torque is significant enough (i.e., large enough to overcome the bias of spring stack 32), screw shaft 22 rotates relative to RGA 42. RGA 42 is secured within lower seal housing 20 such that it does not rotate relative thereto. As screw shaft 22 rotates relative to RGA 42, the geometry of the plurality of helical grooves 70, 72 and plurality of ball bearings 44 results in screw shaft 22 moving uphole, effectively shortening the length of the drill string and reducing the weight on the drill bit to reduce the reactionary torque. The uphole movement of screw shaft 22 is resisted by the bias of spring stack 32. The amount of uphole translation depends upon the amount of reactionary torque encountered, the stiffness of spring stack 32, and the angle of the plurality of helical grooves 70, 72. Those having skill in the art will appreciate that the behavior of slip stick tool 10 can be tuned by changing parameters of stick slip tool 10, such as the length and stiffness of spring stack 32, the angle of the plurality of helical grooves 70, 72, and the like. Once the reactionary torque is sufficiently reduced (i.e., the bias of spring stack 32 overcomes the reactionary torque), the bias of spring stack 32 urges spring mandrel 40, and thus screw shaft 22, back downhole into the elongated configuration of FIG. 8.

Although various embodiments of the present disclosure have been illustrated in the accompanying Drawings and described in the foregoing Detailed Description, it will be understood that the present disclosure is not limited to the embodiments disclosed herein, but is capable of numerous rearrangements, modifications, and substitutions without departing from the spirit of the disclosure as set forth herein.

The term "substantially" is defined as largely but not necessarily wholly what is specified, as understood by a person of ordinary skill in the art. In any disclosed embodiment, the terms "substantially", "approximately", "generally", and "about" may be substituted with "within [a percentage] of" what is specified, where the percentage includes 0.1, 1, 5, and 10 percent.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a", "an", and other singular terms are intended to include the plural forms thereof unless specifically excluded.

What is claimed is:

1. A rotary glide system for a downhole tool, the rotary glide system comprising:

a shaft comprising a plurality of helical grooves formed into an outer surface of the shaft; and a ball bearing sleeve configured to fit around the shaft and comprising:

a plurality of helical grooves formed into an inner surface of the sleeve;

a first slot that extends from a first end of the ball bearing sleeve and intersects a helical groove of the plurality of helical grooves; and a first ball stop comprising a first tab that extends into the first slot of the ball bearing sleeve.

2. The rotary glide system of claim 1, wherein the ball bearing sleeve further comprises:

a second slot that extends from a second end of the ball bearing sleeve; and a second ball stop comprising a second tab that extends into the second slot of the ball bearing sleeve.

3. The rotary glide system of claim 2, wherein the second ball stop comprises a third tab that extends from the second ball stop in an opposite direction from the second tab.

4. The rotary glide system of claim 1, further comprising a plurality of ball bearings that fit within channels formed by the plurality of grooves of the shaft and the plurality of grooves of the ball bearing sleeve.

5. The rotary glide system of claim 1, wherein the ball bearing sleeve and the shaft are configured to be able to rotate relative to one another.

6. A stick slip tool comprising:

a rotary glide system comprising:

a shaft comprising a plurality of helical grooves formed into an outer surface of the shaft;

a ball bearing sleeve configured to fit around the shaft and comprising:

a plurality of helical grooves formed into an inner surface of the sleeve;

a first slot that extends from a first end of the ball bearing sleeve and intersects a helical groove of the plurality of helical grooves; and a first ball stop comprising a first tab that extends into the first slot of the ball bearing sleeve;

a spring mandrel coupled at a first end to the shaft; and a spring stack situated around the spring mandrel, wherein the spring stack resists axial motion of the spring mandrel.

7. The stick slip tool of claim 6, further comprising:

a wash pipe coupled to a second end of the spring mandrel; and a floating piston situated around the wash pipe.

8. The stick slip tool of claim 7, further comprising a piston housing in which the floating piston is movably contained.

9. The stick slip tool of claim 6, further comprising:

a seal housing coupled to a distal end of the rotary glide system, wherein the rotary glide system does not rotate relative to the seal housing but can rotate relative to the shaft.

10. The stick slip tool of claim 6 further comprising a axial bore that passes through the stick slip tool.

11. The stick slip tool of claim 6, wherein the ball bearing sleeve further comprises:

a second slot that extends from a second end of the ball bearing sleeve; and a second ball stop comprising a second tab that extends into the second slot of the ball bearing sleeve.

12. The stick slip tool of claim 11, wherein the second ball stop comprises a third tab that extends from the second ball stop in an opposite direction from the second tab.

13. The stick slip tool of claim 6, further comprising a plurality of ball bearings that fit within channels formed by the plurality of grooves of the shaft and the plurality of grooves of the ball bearing sleeve.

14. The stick slip tool of claim 6, wherein the ball bearing sleeve and the shaft are configured to be able to rotate relative to one another.

15. The stick slip tool of claim 6, wherein a length of the stick slip tool is reduced in the presence of a reactionary torque.

16. The stick slip tool of claim 6, wherein the spring stack comprises a plurality of Bellville washers.

* * * * *